US006719219B1

(12) United States Patent
Wang

(10) Patent No.: US 6,719,219 B1
(45) Date of Patent: Apr. 13, 2004

(54) SPRAYER NOZZLE HAVING MULTIPLE SPRAY PATTERN

(76) Inventor: Chin Chung Wang, P.O. Box 63-298, Taichung (TW), 406

( * ) Notice: Subject to any disclaimer, the term of this patent is extended or adjusted under 35 U.S.C. 154(b) by 0 days.

(21) Appl. No.: 10/452,265

(22) Filed: May 30, 2003

(51) Int. Cl.[7] ..... B05B 7/02
(52) U.S. Cl. ..... 239/526; 239/392; 239/394
(58) Field of Search ..... 239/526, 525, 239/442, 392, 394

(56) References Cited

U.S. PATENT DOCUMENTS 5,540,386 A * 7/1996 Roman ..... 239/394
5,598,978 A 2/1997 Wang ..... 239/394
5,823,442 A 10/1998 Guo ..... 239/394
5,884,847 A * 3/1999 Christopher ..... 239/390

* cited by examiner

*Primary Examiner*—Christopher Kim

(57) ABSTRACT

A sprayer nozzle includes a housing having a center bore to receive water, and a rotor having a center hole to receive a pivot shaft which may rotatably secure the rotor to the housing. The pivot shaft is offset from the center bore of the housing, and the rotor includes a number of passages disposed around the center hole of the rotor, and arranged to be selectively aligned with the center bore of the housing when the rotor is rotated relative to the housing, to allow the water from the center bore of the housing to selectively flow out through either of the passages of the rotor, and to form different water spraying patterns.

10 Claims, 6 Drawing Sheets

SPRAYER NOZZLE HAVING MULTIPLE SPRAY PATTERN

BACKGROUND OF THE INVENTION

1. Field of the Invention

The present invention relates to a sprayer nozzle, and more particularly to a sprayer nozzle having multiple spraying patterns to be selected by users.

2. Description of the Prior Art

Various kinds of typical sprayer devices have been developed and comprise a spray nozzle rotatably attached to the front portion of a sprayer gun body, and having a number of orifices or openings or spraying patterns formed or provided therein, and to be selected by users.

For example, U.S. Pat. No. 5,598,978 to Wang, and U.S. Pat. No. 5,823,442 to Guo disclose two of the typical sprayer devices which also comprise a spray nozzle rotatably attached to the sprayer gun body and having a number of spraying patterns provided therein and to be selected by users.

The sprayer gun body includes an off-center water outlet formed therein, and the sprayer nozzle includes a discharging cover rotatably attached to the front portion of the sprayer gun body, and the discharging cover includes a number of orifices or openings formed in the outer peripheral portion thereof, and to be selectively aligned with the water outlet of the sprayer gun body when the discharging cover is rotated relative to the sprayer gun body.

Normally, the discharging cover is rotatably attached to the front portion of the sprayer gun body with a fastener that is disposed or located in the center of both the discharging cover and the front portion of the sprayer gun body, such that the water may not flow out through the center of the discharging cover and the sprayer gun body.

However, the water outlet of the sprayer gun body is offset or disengaged from the center portion thereof, and the sprayer gun body includes a water passage formed therein and communicating with the water outlet thereof and having one or more corners or turns that may reduce the water force or water flowing speed, such that the water may not be swiftly flown out of the sprayer nozzle.

The present invention has arisen to mitigate and/or obviate the afore-described disadvantages of the conventional sprayer nozzles for spraying devices.

SUMMARY OF THE INVENTION

The primary objective of the present invention is to provide a sprayer nozzle including a number of spraying patterns to be selected by users and arranged for allowing the water to flow out through the center portion of the sprayer nozzle.

In accordance with one aspect of the invention, there is provided a sprayer nozzle comprising a housing including a center bore formed therein to receive water to be sprayed, a rotor including a center hole formed therein, and a pivot shaft engaged through the center hole of the rotor and attached to the housing, to rotatably secure the rotor to the housing, the pivot shaft being offset from the center bore of the housing, and the rotor including a first passage and at least one second passage formed therein and disposed around the center hole of the rotor, and arranged to be selectively aligned with the center bore of the housing when the rotor is rotated relative to the housing, to allow the water from the center bore of the housing to selectively flow out through either of the first passage or the second passage of the rotor.

The rotor includes various or different patterns formed in the outer portion of the passages to form predetermined or different water spraying patterns.

The housing includes an aperture formed therein, the rotor includes a stud extended therefrom and rotatably received in the aperture of the housing, to stably and rotatably secure the rotor to the housing.

The housing includes a circular depression formed therein, the rotor includes a circular outer peripheral surface formed therein and rotatably received in the circular depression of the housing, to stably and rotatably secure the rotor to the housing.

A spring biased projection may further be provided and received in the housing, and engageable with the rotor, to position the rotor to the housing, and to maintain an alignment of the center bore of the housing and either of the passages of the rotor.

The rotor includes a plurality of dens formed therein and arranged around the center hole of the rotor, and arranged to receive the spring biased projection, and to position the rotor relative to the housing, and to maintain an alignment of either of the first passage or the second passage of the rotor with the center bore of the housing.

A rotating device may further be provided to rotate the rotor relative to the housing. The rotor includes a plurality of teeth formed thereon, the rotating device includes a control ferrule rotatably attached to the housing and including a plurality of teeth formed therein and engaged with the teeth of the rotor, to rotate the rotor relative to the housing when the control ferrule is rotated relative to the housing.

A casing is further provided and secured in front of the housing, the casing includes a center hole formed therein and defined by a hub, and selectively aligned with either of the first passage or the second passage of the rotor when the rotor is rotated relative to the housing The casing includes a peripheral rib extended therefrom, the rotor includes a circular outer peripheral surface formed therein and rotatably received in the peripheral rib of the casing, to stably and rotatably secure the rotor between the housing and the casing.

The casing includes a chamber formed therein and defined between a rear wall and a front wall, the front wall includes a plurality of perforations formed therein and communicating with the chamber of the casing, the rear wall includes at least one passageway formed therein and communicating with the chamber of the casing, the rotor includes at least one groove formed therein and communicating with the second passage of the rotor, to receive water from the second passage of the rotor.

The rotor includes a cap attached thereto, to block the second passage of the rotor, and to selectively block the center hole of the casing when the cap is aligned with the center hole of the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
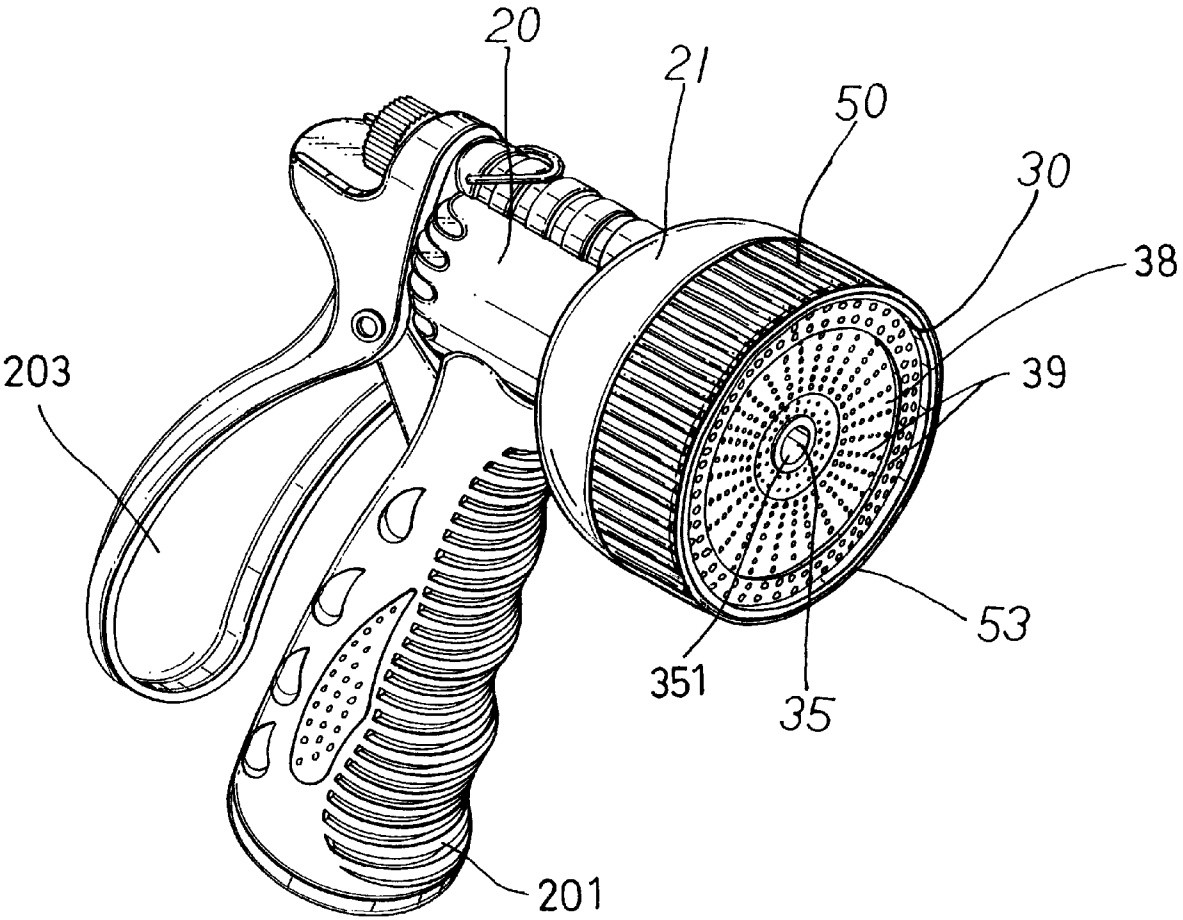
FIG. 1 is a front perspective view of a sprayer gun having a sprayer nozzle in accordance with the present invention.

Referring to the drawings, and initially to FIGS. 1–5, a sprayer nozzle in accordance with the present invention comprises a housing 21 attached or formed or provided on the front portion of a sprayer gun body 20. The sprayer gun includes a typical handle 201 extended from the sprayer gun body 20, and a typical control hand grip 203 attached to the sprayer gun body 20, for operating the sprayer gun. The configuration of the sprayer gun body 20 and the handle 201 and the control hand grip 203 is typical and will not be described in further details.

The housing 21 includes a center bore 22 formed therein to receive water to be sprayed, and a circular depression 23 formed therein and communicating with the center bore 22 thereof. The circular depression 23 of the housing 21 is offset from or eccentric relative to the center bore 22 thereof. The housing 21 further includes an aperture 24 and a cavity 25 formed therein and communicating with the circular depression 23 thereof.

The housing 21 includes a peripheral wall 26 extended forwardly therefrom to form or define a chamber 27 in the front portion thereof or in the peripheral wall 26, and includes an inner peripheral shoulder 28 formed in the front portion of the peripheral wall 26. A spring 70 and a projection 71 are received in the cavity 25 of the housing 21, and the projection 71 is arranged to be biased or forced partially out of the cavity 25 of the housing 21 by the spring 70.

A rotor 40 includes a center hole 47 formed therein to receive a fastener or a pivot shaft 48 which may be threaded to the housing 21 and which may rotatably secure the rotor 40 to the housing 21. The rotor 40 includes a stud 403 extended therefrom and rotatably received in the aperture 24 of the housing 21, for stably and rotatably attaching the rotor 40 to the housing 21.

The rotor 40 may further include a circular outer peripheral shoulder or surface 42 formed or provided in the rear and outer portion thereof and rotatably received in the circular depression 23 of the housing 21, for further stably and rotatably attaching the rotor 40 to the housing 21, and for allowing the rotor 40 to be smoothly rotated relative to the housing 21.

Figure 2:
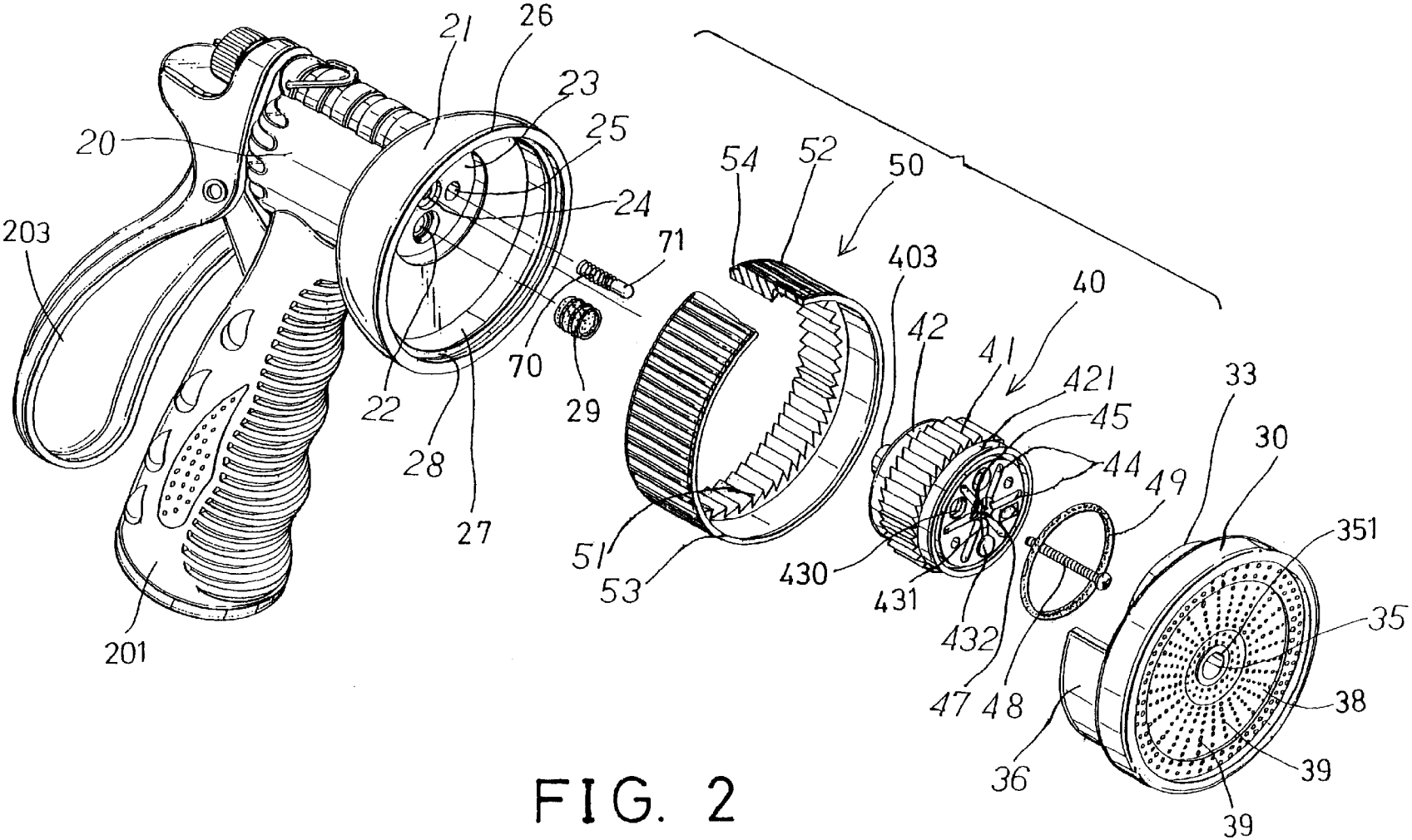
FIG. 2 is an exploded view of the sprayer nozzle.
Figure 3:
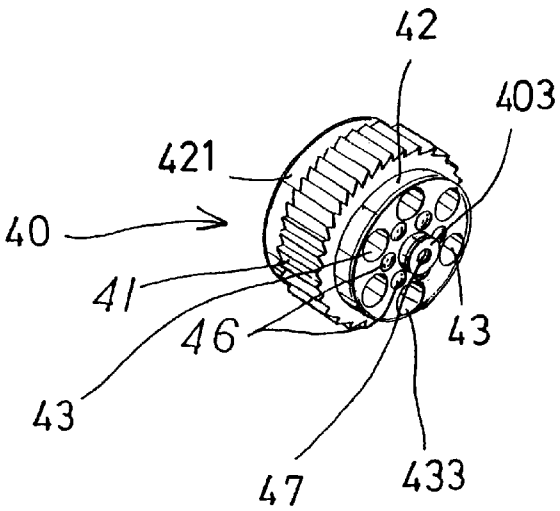
FIG. 3 is a rear perspective view of a rotor of the sprayer nozzle.
Figure 4:
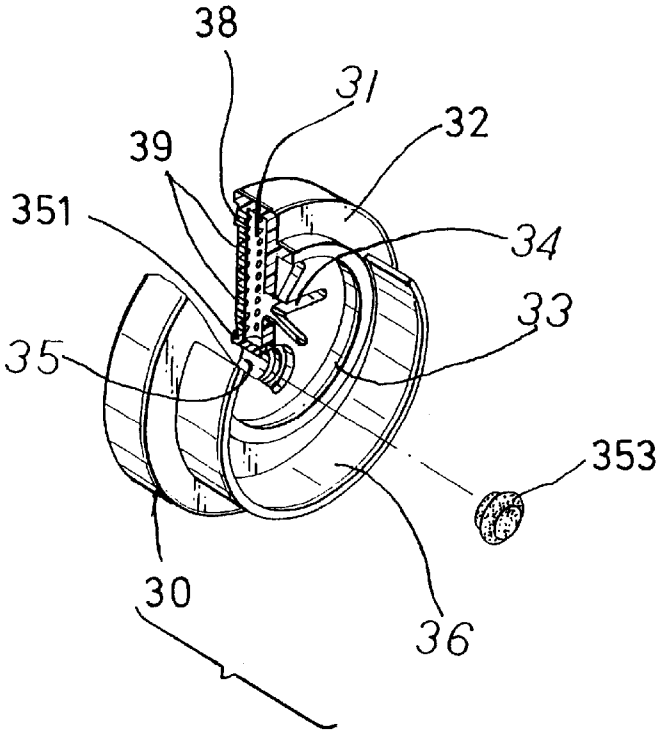
FIG. 4 is a partial exploded view of a front casing of the sprayer nozzle.

As best shown in FIG. 3, the rotor 40 includes a number of passages 43 formed therein and arranged around the center hole 47 of the rotor 40, and arranged to be selectively aligned with the center bore 22 of the housing 21 when the rotor 40 is rotated relative to the housing 21. The rotor 40 includes various or different patterns 430 formed in the front ends of the passages 43 thereof respectively (FIGS. 2, 5, 6), to form various spraying patterns.

A sealing ring or gasket 29 may be engaged in the center bore 22 of the housing 21 and engaged between the rotor 40 and the housing 21, to make a water tight seal between the rotor 40 and the housing 21, and to allow the water from the center bore 22 of the housing 21 to flow into either of the selected passages 43 of the rotor 40.

The rotor 40 further includes a number of dens 46 formed in the rear portion thereof (FIGS. 3, 8), and arranged around the center hole 47 of the rotor 40, and arranged to receive the spring biased projection 71 which may position the rotor 40 relative to the housing 21, and which may maintain the alignment of either of the respective passages 43 of the rotor 40 with the center bore 22 of the housing 21, to allow the water from the center bore 22 of the housing 21 to selectively flow through either of the passages 43 of the rotor 40.

Figure 5:
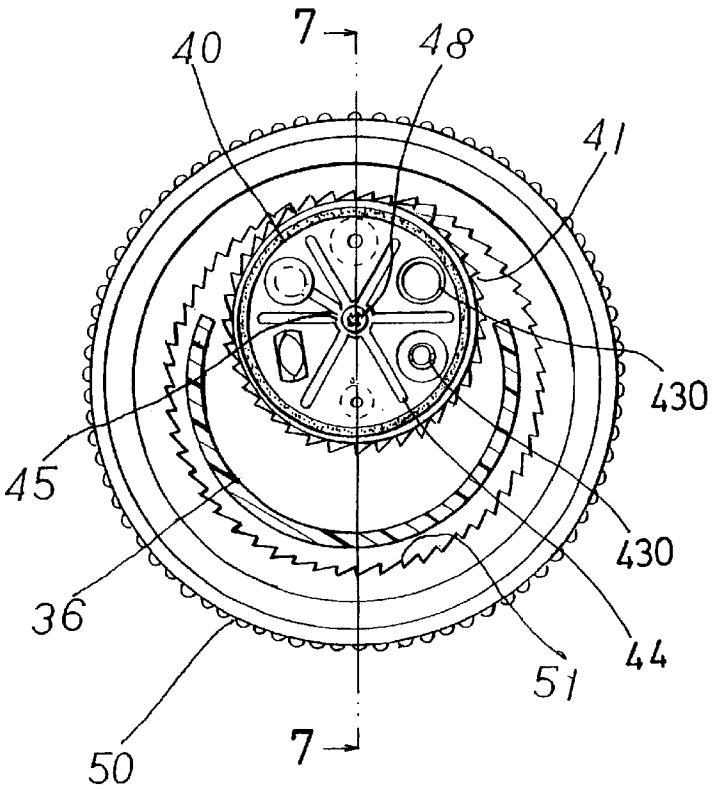
FIGS. 5, 6 are partial cross sectional view taken along lines 5—5 and 6—6 of FIGS. 7, 8 respectively.
Figure 6:
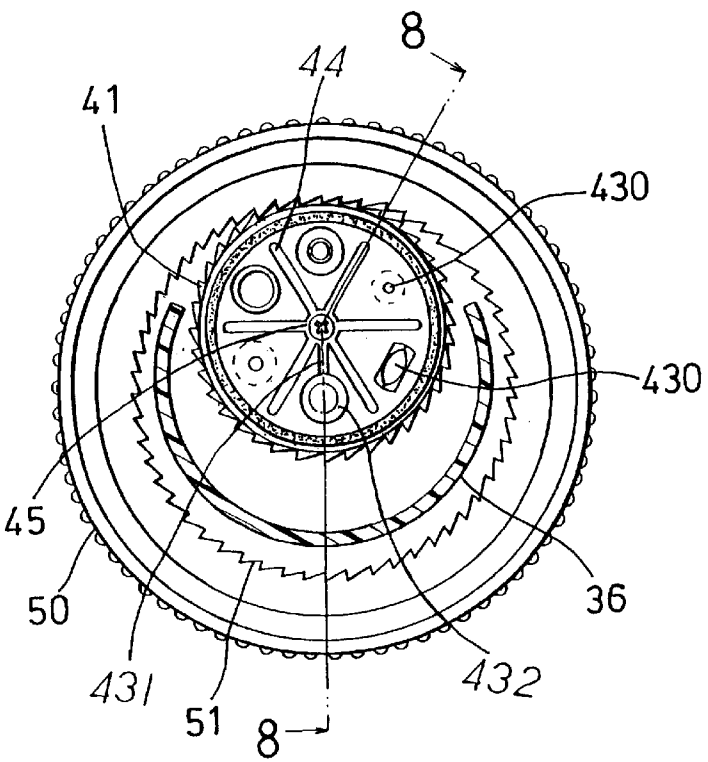

As shown in FIGS. 2, 5, 6, the rotor 40 includes one or more radially extended grooves 44 formed therein and arranged around the center hole 47 of the rotor 40, and disengaged from the passages 43 of the rotor 40, and having inner portions coupled together or communicated with each other at a space 45.

The rotor 40 includes a slot 431 formed therein and communicating one of the passages 433 of the rotor 40 (FIGS. 3, 8) with either of the radially extended grooves 44 or the space 45 of the rotor 40, to allow the water from the one passage 43 of the rotor 40 to flow through the slot 431 and/or the space 45 and/or either of the radially extended grooves 44 of the rotor 40.

The rotor 40 further includes a cap 432 attached to the front portion thereof (FIGS. 2, 8), to guide the water from the one passage 433 of the rotor 40 to flow radially out through the slot 431 and/or the space 45 and/or either of the radially extended grooves 44 of the rotor 40, and to prevent the water from directly flow forwardly out of the one passage 433 of the rotor 40.

The rotor 40 further includes a circular outer peripheral shoulder or surface 421 formed or provided in the front and outer portion thereof (FIGS. 2, 3), and includes a number of teeth 41, such as ratchet teeth 41 extended or provided on the outer peripheral portion thereof, and preferably arranged between the circular outer peripheral shoulders or surfaces 42, 421 thereof.

A control ferrule 50 includes a rear peripheral flange 54 provided on the rear portion thereof and rotatably engaged in the inner peripheral shoulder 28 of the housing 21, for rotatably attaching or securing the control ferrule 50 to the housing 21, and for stably guiding the control ferrule 50 to rotate relative to the housing 21. The control ferrule 50 is provided as a rotating means for rotating the rotor 40 relative to the housing 21.

The control ferrule 50 includes a number of teeth 51, such as ratchet teeth 51 extended or provided in the inner peripheral portion thereof, and engaged with the teeth 41 of the rotor 40, to rotate the rotor 40 relative to the housing 21 when the control ferrule 50 is rotated relative to the housing 21. The control ferrule 50 includes a knurled or serrated outer peripheral surface 52 formed or provided thereon for allowing the control ferrule 50 to be easily rotated relative to the housing 21.

A front casing 30 includes a chamber 31 formed or defined between a rear wall 32 and a front wall 38, and includes a center hole 35 formed therein and defined by a hub 351 which may separate the center hole 35 and the chamber 31 thereof from each other. The front casing 30 is rotatably received in the front portion 53 of the control ferrule 50. A sealing ring or gasket 353 may be engaged in the hub 351 and engaged between the rotor 40 and the front casing 30, to make a water tight seal between the rotor 40 and the front casing 30.

The front casing 30 includes a curved extension 36 extended rearwardly from the rear wall 32 and secured to the housing 21 with adhesive materials, fasteners or latches (not shown), or by welding processes, to solidly secure the front casing 30 to the front portion of the housing 21, and thus to stably and rotatably retain the control ferrule 50 between the housing 21 and the front casing 30.

The front casing 30 includes a circular or peripheral rib 33 extended rearwardly from the rear wall 32 and rotatably engaged onto the circular outer peripheral surface 421 of the rotor 40, to stably and rotatably retain the rotor 40 between the housing 21 and the front casing 30. A sealing ring 39 may be engaged between the outer peripheral portion of the rotor 40 and the front casing 30, to make a water tight seal between the outer peripheral portion of the rotor 40 and the front casing 30.

The hub 351 or the center hole 35 of the front casing 30 is arranged to be aligned with the center bore 22 of the housing 21, and to be aligned with either of the passages 43 or either of the patterns 430 of the rotor 40, to allow the water to flow out through the center hole 35 of the front casing 30 via either of the patterns 430 or passages 43 of the rotor 40, to form various or different spraying patterns.

The front casing 30 includes a number of perforations 39 formed in the front wall 38 and communicating with the chamber 31 of the front casing 30, and includes one or more passageways 34 formed in the rear wall 32 and communicating with the chamber 31 of the front casing 30, to allow water to flow out through the perforations 39 of the front casing 30 via the passageways 34 and the chamber 31 of the front casing 30.

Either of the passageways 34 of the rear wall 32 or of the front casing 30 may be communicated with either of the grooves 44 or the space 45 of the rotor 40, to allow the water from the one passage 43 of the rotor 40 to flow through the slot 431 and/or the space 45 and/or either of the radially extended grooves 44 of the rotor 40, and then to flow through the passageways 34 and the chamber 31 of the front casing 30 and the perforations 39 of the front casing 30.

Figure 8:
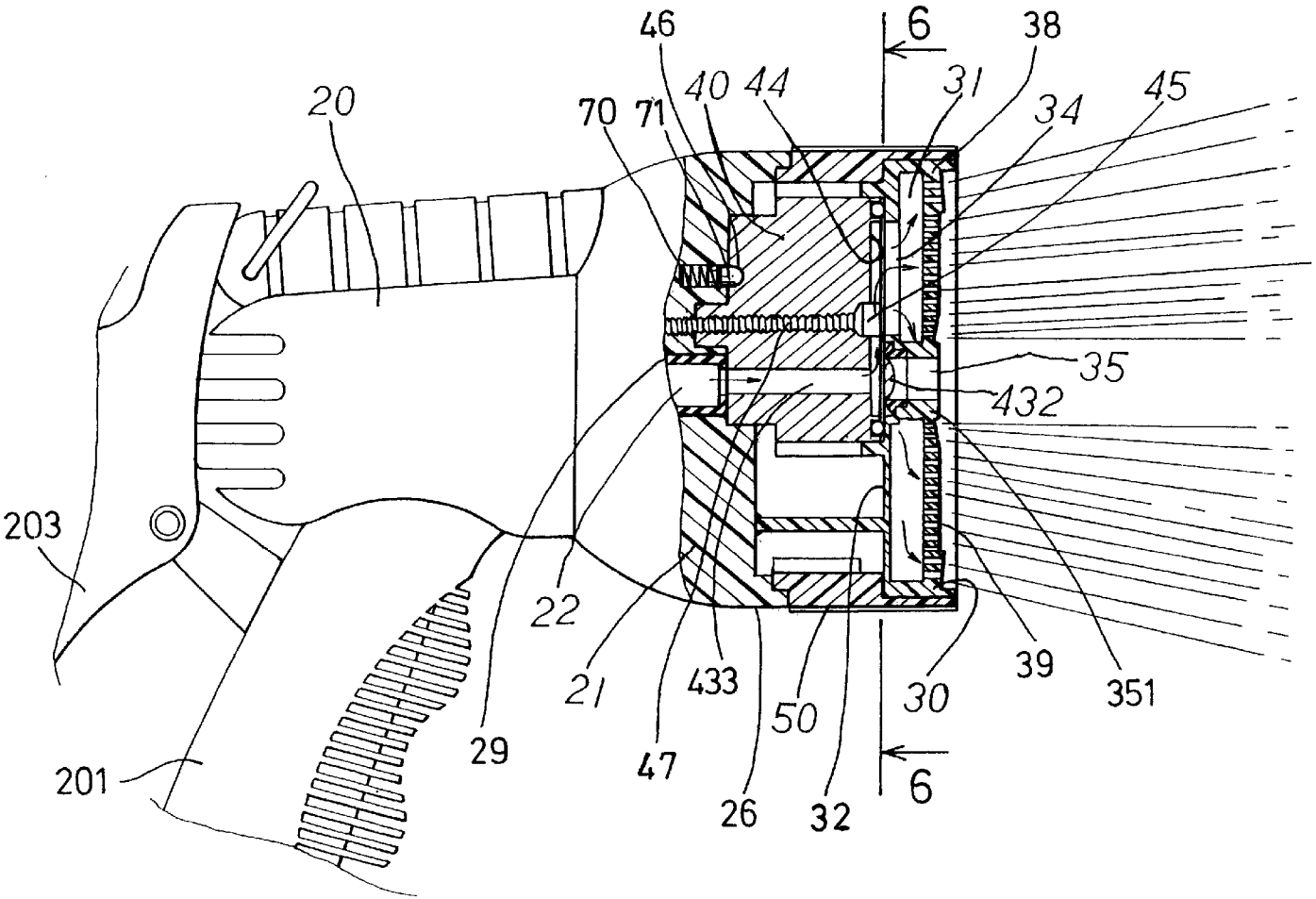

At this moment, the cap 432 of the rotor 40 is engaged with the hub 35 of the front casing 30, to block the center hole 35 of the front casing 30, and to prevent water from flowing out through the center hole 35 of the front casing 30, and thus to allow the water to flow out through the perforations 39 of the front casing 30 only, best shown in FIGS. 6, 8.

Figure 7:
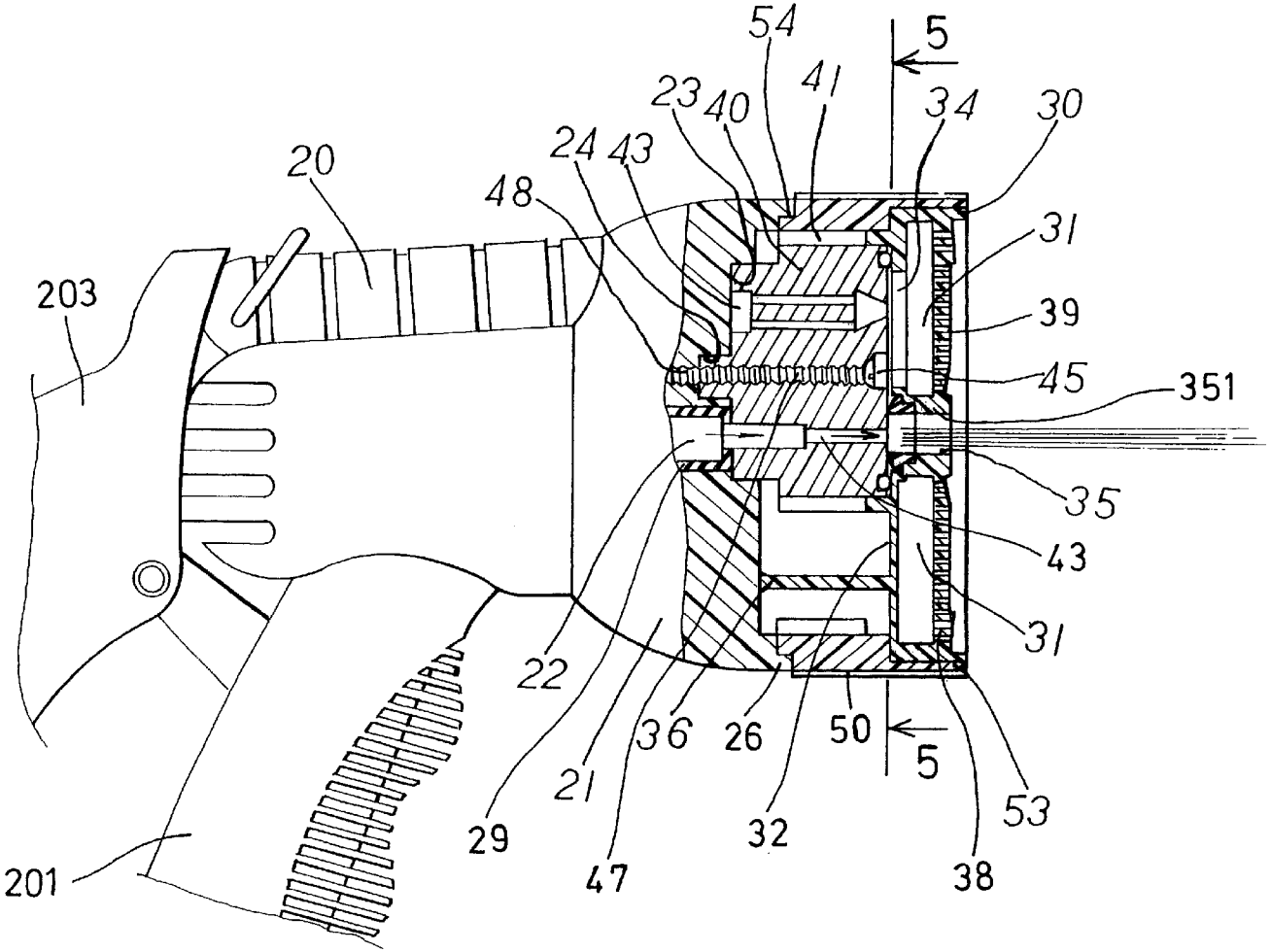
FIGS. 7, 8 are partial cross sectional view taken along lines 7—7 and 8—8 of FIGS. 5, 6 respectively.

In operation, as shown in FIGS. 5 and 7, the rotor 40 may be rotated relative to the housing 21, by such as the control ferrule 50, to align either of the passages 43 of the rotor 40 with the center bore 22 of the housing 21, and to allow the water from the center bore 22 of the housing 21 to selectively flow through either of the passages 43 of the rotor 40, and to directly flow forwardly out through the center hole 35 of the front casing 30, best shown in FIG. 7.

As shown in FIGS. 6 and 8, when the rotor 40 is rotated relative to the housing 21 to align the passages 433 of the rotor 40 with the center bore 22 of the housing 21, the cap 432 of the rotor 40 may be caused to engage with the hub 35 of the front casing 30, and to block the center hole 35 of the front casing 30, and thus to prevent the water from flowing out through the center hole 35 of the front casing 30. At this moment, the water may only flow out through the perforations 39 of the front casing 30 via the slot 431 and/or the space 45 and/or the radially extended grooves 44 of the rotor 40 and the passageways 34 and the chamber 31 of the front casing 30.

The conventional sprayer devices do not include a rotor rotatably secured to the front portion of a housing, and do not teach a rotor having one or more passages 43, 433 selectively aligned with a center bore 22 of a housing 21, to allow the water to flow through the aligned passages 43, 433 and the center bore 22 of the housing 21.

Accordingly, the sprayer nozzle in accordance with the present invention includes a number of spraying patterns to be selected by users and arranged for allowing the water to flow out through the center portion of the sprayer nozzle. Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer nozzle comprising:

a housing including a center bore formed therein to receive water to be sprayed, a rotor including a center hole formed therein, and including a plurality of teeth formed thereon, a pivot shaft engaged through said center hole of said rotor and attached to said housing, to rotatably secure said rotor to said housing, said pivot shaft being offset from said center bore of said housing, and said rotor including a first passage and at least one second passage formed therein and disposed around said center hole of said rotor, and arranged to be selectively aligned with said center bore of said housing when said rotor is rotated relative to said housing, to allow the water from said center bore of said housing to selectively flow out through either of said first passage or said at least one second passage of said rotor, and means for rotating said rotor relative to said housing, said rotating means including a control ferrule rotatable attached to said housing and including a plurality of teeth formed therein and engaged with said teeth of said rotor, to rotate said rotor relative to said housing when said control ferrule is rotated relative to said housing.

2. The sprayer nozzle as claimed in claim 1, wherein said rotor includes a pattern formed in an outer portion of said first passage to form a predetermined water spraying pattern.

3. The sprayer nozzle as claimed in claim 1, wherein said housing includes an aperture formed therein, said rotor includes a stud extended therefrom and rotatably received in said aperture of said housing, to stably and rotatably secure said rotor to said housing.

4. The sprayer nozzle as claimed in claim 1, wherein said housing includes a circular depression formed therein, said rotor includes a circular outer peripheral surface formed therein and rotatably received in said circular depression of said housing, to stably and rotatably secure said rotor to said housing.

5. The sprayer nozzle as claimed in claim 1 further comprising a spring biased projection received in said housing, and engageable with said rotor, to position said rotor to said housing.

6. The sprayer nozzle as claimed in claim 5, wherein said rotor includes a plurality of dens formed therein and arranged around said center hole of said rotor, and arranged to receive said spring biased projection, and to position said rotor relative to said housing, and to maintain an alignment of either of said first passage or said at least one second passage of said rotor with said center bore of said housing.

7. The sprayer nozzle as claimed in claim 1 further comprising a casing secured in front of said housing, said casing including a center hole formed therein and defined by a hub, and selectively aligned with either of said first passage or said at least one second passage of said rotor when said rotor is rotated relative to said housing.

8. A sprayer nozzle comprising:

a housing including a center bore formed therein to receive water to be sprayed, a rotor including a center hole formed therein, and a pivot shaft engaged through said center hole of said rotor and attached to said housing, to rotatable secure said rotor to said housing, said pivot shaft being offset from said center bore of said housing, and said rotor including a first passage and at least one second passage formed therein and disposed around said center hole of said rotor, and arranged to be selectively aligned with said center bore of said housing when said rotor is rotated relative to said housing, to allow the water from said center bore of said housing to selectively flow out through either of said first passage or said at least one second passage of said rotor, and a casing secured in front of said housing, said casing including a center hole formed therein and defined by a hub, and selectively aligned with either of said first passage or said at least one second passage of said rotor when said rotor is rotated relative to said housing, said casing including a peripheral rib extended therefrom, said rotor including a circular outer peripheral surface formed therein and rotatably received in said peripheral rib of said casing, to stably and rotatably secure said rotor between said housing and said casing.

9. A sprayer nozzle comprising:

a housing including a center bore formed therein to receive water to be sprayed;

a rotor including a center hole formed therein, and a pivot shaft engaged through said center hole of said rotor and attached to said housing, to rotatable secure said rotor to said housing, said pivot shaft being offset from said center bore of said housing, and said rotor including a first passage and at least one second passage formed therein and disposed around said center hole of said rotor, and arranged to be selectively aligned with said center bore of said housing when said rotor is rotated relative to said housing, to allow the water from said center bore of said housing to selectively flow out through either of said first passage or said at least one second passage of said rotor, and a casing secured in front of said housing, said casing including a center hole formed therein and defined by a hub, and selectively aligned with either of said first passage or said at least one second passage of said rotor when said rotor is rotated relative to said housing, said casing including a chamber formed therein and defined between a rear wall and a front wall, said front wall including a plurality of perforations formed therein and communicating with said chamber of said casing, said rear wall including at least one passageway formed therein and communicating with said chamber of said casing, said rotor including at least one groove formed therein and communicating with said at least one second passage of said rotor, to receive water from said at least one second passage of said rotor.

10. The sprayer nozzle as claimed in claim 9, wherein said rotor includes a cap attached thereto, to block said at least one second passage of said rotor, and to selectively block said center hole of said casing when said cap is aligned with said center hole of said casing.

* * * * *